US007901172B2

(12) United States Patent
Yoshie

(10) Patent No.: US 7,901,172 B2
(45) Date of Patent: Mar. 8, 2011

(54) BIND PROCESSING METHOD, BIND PROCESSING DEVICE AND BINDER CARTRIDGE

(75) Inventor: Toru Yoshie, Tokyo (JP)

(73) Assignee: Max Co., Ltd., Tokyo (JP)

( * ) Notice: Subject to any disclaimer, the term of this patent is extended or adjusted under 35 U.S.C. 154(b) by 0 days.

(21) Appl. No.: 12/713,854

(22) Filed: Feb. 26, 2010

(65) Prior Publication Data

US 2010/0150683 A1 Jun. 17, 2010

Related U.S. Application Data

(62) Division of application No. 10/567,862, filed on Feb. 10, 2006, now Pat. No. 7,744,326.

(51) Int. Cl.
*B42B 5/08* (2006.01)
*B42B 9/00* (2006.01)

(52) U.S. Cl. ..... 412/40; 412/34; 412/42; 412/38

(58) Field of Classification Search ..... 412/1, 6, 412/7, 33, 34, 38, 39, 40, 42
See application file for complete search history.

(56) References Cited

U.S. PATENT DOCUMENTS

| | | | | |
|---|---|---|---|---|
| 4,558,981 | A | 12/1985 | Fabrig | |
| 2004/0018041 | A1 | 1/2004 | Amdahl et al. | |
| 2009/0232622 | A1 * | 9/2009 | Okada et al. | 412/42 |

FOREIGN PATENT DOCUMENTS

| | | |
|---|---|---|
| JP | UM-1978-46215 | 4/1978 |
| JP | UM-1992-76486 | 7/1992 |
| JP | 2002-289376 | 10/2000 |
| JP | A-2000-289376 | 10/2000 |
| JP | A-2001-018571 | 1/2001 |
| WO | 99/39920 | 8/1999 |
| WO | 03/093025 A1 | 11/2003 |

* cited by examiner

*Primary Examiner* — Dana Ross
*Assistant Examiner* — Pradeep C Battula
(74) *Attorney, Agent, or Firm* — Morgan, Lewis & Bockius LLP

(57) ABSTRACT

A binder cartridge (51) that can accommodate a large number of binders (61), which are connected in parallel to each other by an engaging mechanism. A right angle crank-shaped guide groove (55) is formed in a gate portion (54) at the front end of the binder cartridge. A binder in the front row of the binder cartridge is moved by a binder lateral movement mechanism (7) along the crank-shaped guide groove in the lateral direction and is separated from the other binders. A pair of upper and lower pushers (12, 13) of a bind mechanism portion (5) pinch division ring portions of the binder in the vertical direction and insert the division ring portions into a punch hole formed on the sheets of paper.

10 Claims, 17 Drawing Sheets

FIG. 13A1
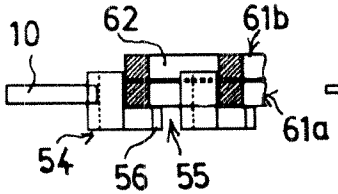
FIG. 13B1
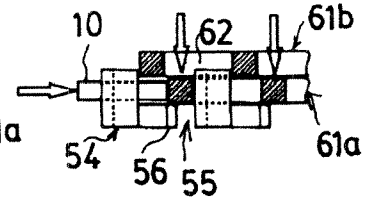
FIG. 13C1
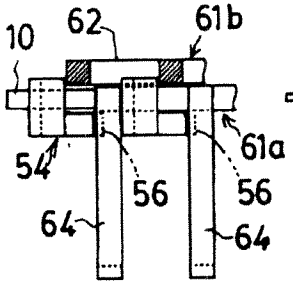
FIG. 13D1
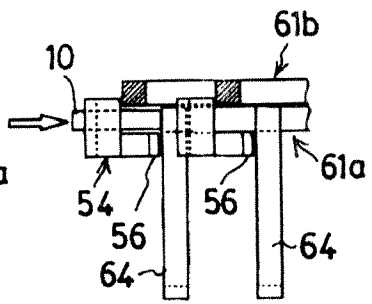
FIG. 13A2
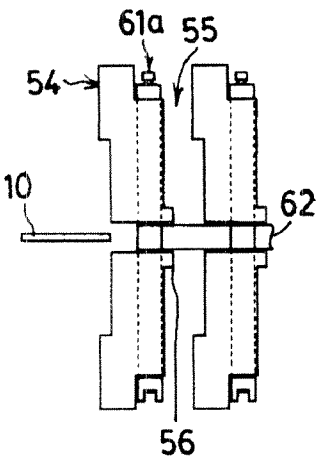
FIG. 13B2
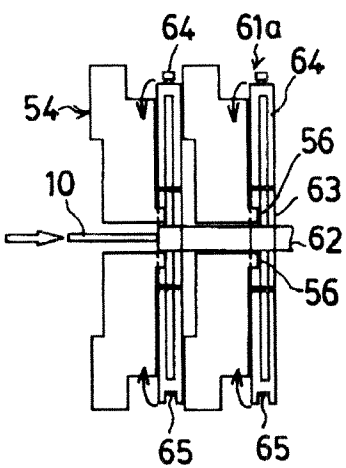
FIG. 13C2
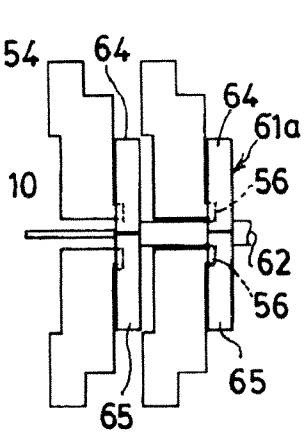
FIG. 13D2
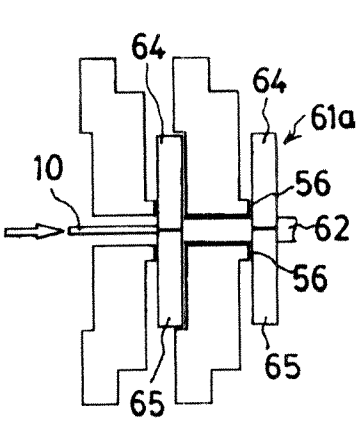

BIND PROCESSING METHOD, BIND PROCESSING DEVICE AND BINDER CARTRIDGE

This is a divisional application of application Ser. No. 10/567,862, filed on Feb. 10, 2006 now U.S. Pat. No. 7,744,326, which is hereby incorporated by reference.

BACKGROUND OF THE INVENTION

1. Technical Field

The present invention relates to a bind processing method of binding sheets of paper including punch holes, with a binder, a bind processing device, and a binder cartridge. More particularly, the present invention relates to a bind processing method in which binding is automated, a bind processing device and a binder cartridge.

2. Description of Related Art

Concerning the binder for binding sheets of paper or plastics on which punch holes are formed, a binder formed out of resin by means of integral molding is conventionally known. The binder includes substantially circular rings arranged in parallel with each other at regular intervals on a long slender strip. The length of the binder is the same as the longitudinal size of a sheet of paper of regular size. One end of each ring of this binder is connected to the strip and the forward end of each ring is a free end. These plurality of rings are opened and the forward end portions of the rings are inserted into the bunch holes of the sheets of paper When the operator's fingers are separated from the rings, the rings are closed by an elastic restoring force so that the sheets of paper can be bound. However, this method is disadvantageous in that it takes much labor to attach the binder to the sheets of paper.

As an example of the proposition by which this type binder can be simply attached, a binder for binding sheets of paper is disclosed in JP-A-2001-018571. The paper binding device disclosed in this proposition is composed as follows. There is provided a sliding mechanism in which a movable plate having pawls, the shapes of which are reverse-L-shaped, is slid in the lateral and the backward direction. When a binder is set in the main body and the movable plate is slid in an L-shape, the pawls of the movable plate are engaged with the rings of the binder in the lateral direction. Further, the pawls of the movable plate are retreated so that the rings of the binder can be pulled and opened. By this operation, the binder can be simply attached to sheets of loose leaf paper.

Concerning the proposition relating to the structure of the ring type binder itself, JP-A-2000-289376 discloses the following binder. On both sides of a spine portion, the length of which is the same as the longitudinal size of a sheet of paper of regular size, ½ ring portions are arranged in parallel with each other. Protruding portions are provided at the forward end portions of the ½ ring portions in one row, which is opposed to the other row with the spine portion, and recessing portions are provided at the forward end portions of the ½ ring portions in the other row. The protruding portions and recessing portions form an engaging. When the ½ ring portions, which compose a pair, are closed and engaged with each other, the rings are closed. In this way, the attaching property of the binder can be improved.

It takes much time to attach the conventional ring type binder. Although the attaching property of the two-division type binder described in JP-A-2000-289376 has been improved, the attaching must be executed by a hand, as before. JP-A-2001-018571 proposes a binding device for binding sheets of paper in which the attaching work of the binder is made easy. However, according to this binding device for binding sheets of paper, the binders are set in the binding device one by one. Therefore, it takes labor to supply and operate the binder. Accordingly, when a large amount of documents are processed, it takes a long time. For the above reasons, in order to enhance the processing efficiency of binding, a bind processing method capable of continuously executing the bind processing is demanded.

SUMMARY OF THE INVENTION

It is an object of the present invention to provide a bind processing method and a bind processing device capable of continuously conducting a bind processing with a binder.

The present invention is proposed in order to accomplish the above object. The present invention provides a bind processing method in which sheets of loose leaf paper, on which a plurality of punch holes are formed along one side of the sheets of paper, are bound with a binder, the division ring portions of which are arranged at regular intervals along both long sides of a spine portion, comprising the steps of: pinching and closing the division ring portions of the binder when a pair of pushers are driven in the closing direction by an elevating drive mechanism for elevating the pair of pushers symmetrically in the vertical direction; and engaging forward end portions of the division ring portions, which compose a pair in such a manner that the spine portion of the binder is interposed between the division ring portions, with each other in punch holes formed on the sheets of loose leaf paper. Due to the above method, compared with a method in which a large number of ring portions are engaged with each other by a hand work one by one, the binder can be attached in a short period of time.

The present invention provides a bind processing method, in which two sets of the pairs of upper and lower pushers are arranged in the longitudinal direction, one set of the pair of upper and lower pushers pinch back face sides of the division ring portion of the binder so as to rotate the upper and lower division ring portions in the closing direction, and the other set of the pair of upper and lower pushers pinch the forward end sides of the division ring portion of the binder so as to engage the forward end portions of the opposing division ring portions to each other.

The present invention provides a bind processing method, in which a sheet table, which supports sheets of paper to be bound, is made to proceed to the binder by a table moving mechanism for advancing and retreating the sheet table to and from the binder when the pair of pushers conducts binding, so that the generation of abrasion between the division ring portion and the inner wall face of a punch hole can be suppressed when the division ring portion of the binder proceeds into the punch hole on the sheets of paper.

The present invention provides a bind processing device using a binder, along both long sides of the spine portion of which division ring portions are arranged at regular intervals, comprising: a pair of the upper side pusher and the lower side pusher; an elevation drive mechanism for elevating the pair of the upper side pusher and the lower side pusher symmetrically with respect to the vertical direction; and a drive motor, wherein the pair of the upper side pusher and the lower side pusher are driven in the closing direction so as to close the division ring portions of the binder, and forward end portions of the division ring portions, which compose a pair in such a manner that the spine portion of the binder is interposed between the division ring portions, are engaged with each other in punch holes on the sheets of loose leaf paper.

The present invention provides a bind processing device, in which the pair of the upper and the lower pusher include a first upper pusher and a first lower pusher and a second upper pusher and a second lower pusher which are arranged in the longitudinal direction, the first upper pusher and the first lower pusher pinch a back face side of the division ring portion of the binder and rotate the upper and the lower division ring portion, and the second upper pusher and the second lower pusher pinch a forward end portion side of the division ring portion of the binder and engage the forward end portions of the division ring portions opposed to each other.

The present invention provides a bind processing device further comprising: a sheet table for supporting sheets of paper to be bound; and a table moving mechanism for advancing and retreating the sheet table to the binder, wherein when binding is conducted by the upper and lower pusher, the sheet table is advanced toward the binder so as to suppress the occurrence of abrasion caused between the division ring portion and the inner wall face of the punch hole when the division ring portion of the binder proceeds into the punch holes of the sheets of paper.

The present invention provides bind processing device further comprising an elevating pin provided on the sheet table, wherein the elevating pin is inserted into the punch holes of the sheets of paper on the sheet table so as to correct a positional deviation of the punch hole of each sheet of paper.

The present invention provides a bind processing using a binder in which division ring portions are arranged at regular intervals along both long sides of the spine portion, a connection means composed of a pin and a groove is provided on both sides of the spine portion, and the binders can be connected in parallel with each other and when the binders are slid from each other in the lateral direction, the pin and the groove can be released from each other, the bind processing device comprising: a slider for sliding the binder in the lateral direction; and a slider drive mechanism, wherein the front row binder is laterally slid by the slider and separated from the rear row binder.

The present invention provides a bind processing device in which the elevation drive mechanism of the pusher is a feed screw mechanism having a feed screw composed in such a manner that a male screw is formed on one end side of a shaft with respect to the center of the shaft and an inverse male screw is formed on the other end side of the shaft with respect to the center of the shaft.

The present invention provides a bind processing device in which the pusher elevation drive mechanism includes: a pair of levers connected with each other by a pin; and a lever opening and closing mechanism.

The present invention provides a binder cartridge in which a plurality of binders, along both long sides of the spine portions of which division ring portions are arranged at regular intervals, are laminated and accommodated comprising: longitudinal through-groove formed in a vertical intermediate portion on the front wall in the horizontal direction; and a crank-shaped guide groove, the shape of which is formed in a right angle in a plane view, arranged in parallel with the longitudinal through-groove and formed on the front wall, wherein a front row binder can be picked up forward when the front row binder in the binder cartridge and the gate portion, in which the crank portion of the crank-shaped guide groove is formed, are relatively slid in the lateral direction.

According to the present invention, the binder can be attached to sheets of loose leaf paper in a very short period of time by the means in which a pair of pushers are elevated symmetrically in the vertical direction by the elevation drive mechanism and the division ring portions of the division ring shape are pinched by a pair of the upper and the lower pusher so that the pair of division ring portions can be engaged with each other in the punch holes on the sheets of loose leaf paper. By the method in which the binder is separated from a plurality of binders, which are charged in parallel with each other, one by one and binding processing is conducted, it becomes possible to continuously and automatically conduct binding, and the processing efficiency can be enhanced.

BRIEF DESCRIPTION OF THE DRAWINGS

FIG. 12A is a front view showing a central groove, and FIG. 12B is a front view of the other groove.

FIGS. 13A1 to 13D2 are schematic illustrations for explaining operation of a gate portion of a binder cartridge. FIGS. 13A1, 13B1, 13C1 and 13D1 are plan views. FIGS. 13A2, 13B2, 13C2 and 13D2 are front views.

DETAILED DESCRIPTION OF THE EXEMPLARY EMBODIMENTS

First Embodiment

Figure 1:
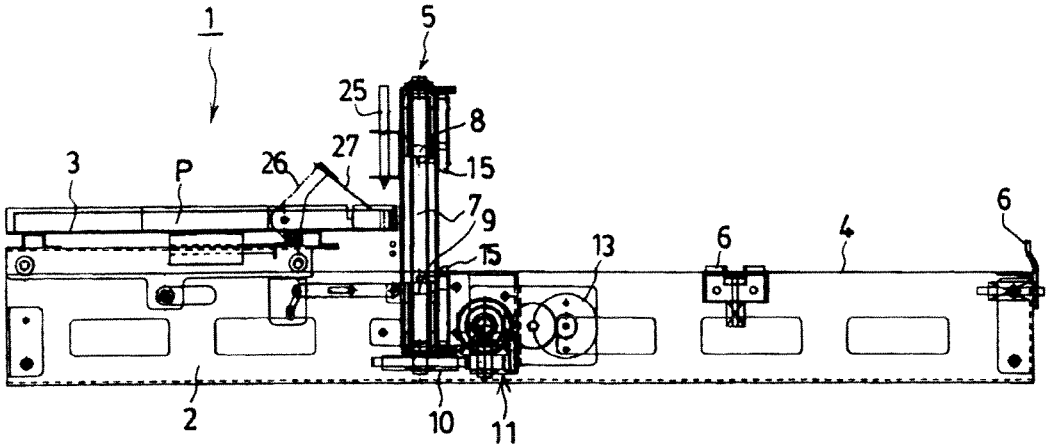
FIG. 1 is a side view showing a bind processing device.
Figure 2:
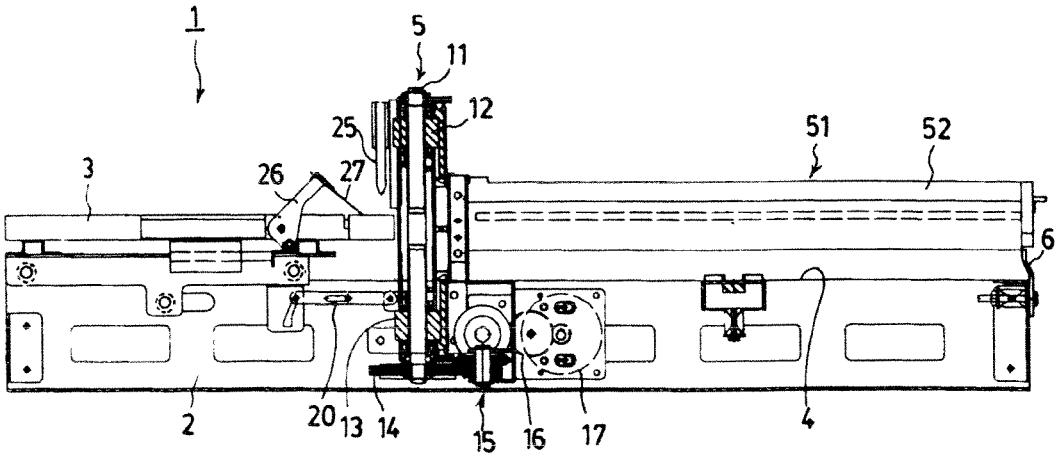
FIG. 2 is a side view showing bind processing device to which a binder cartridge is attached.
Figure 3:
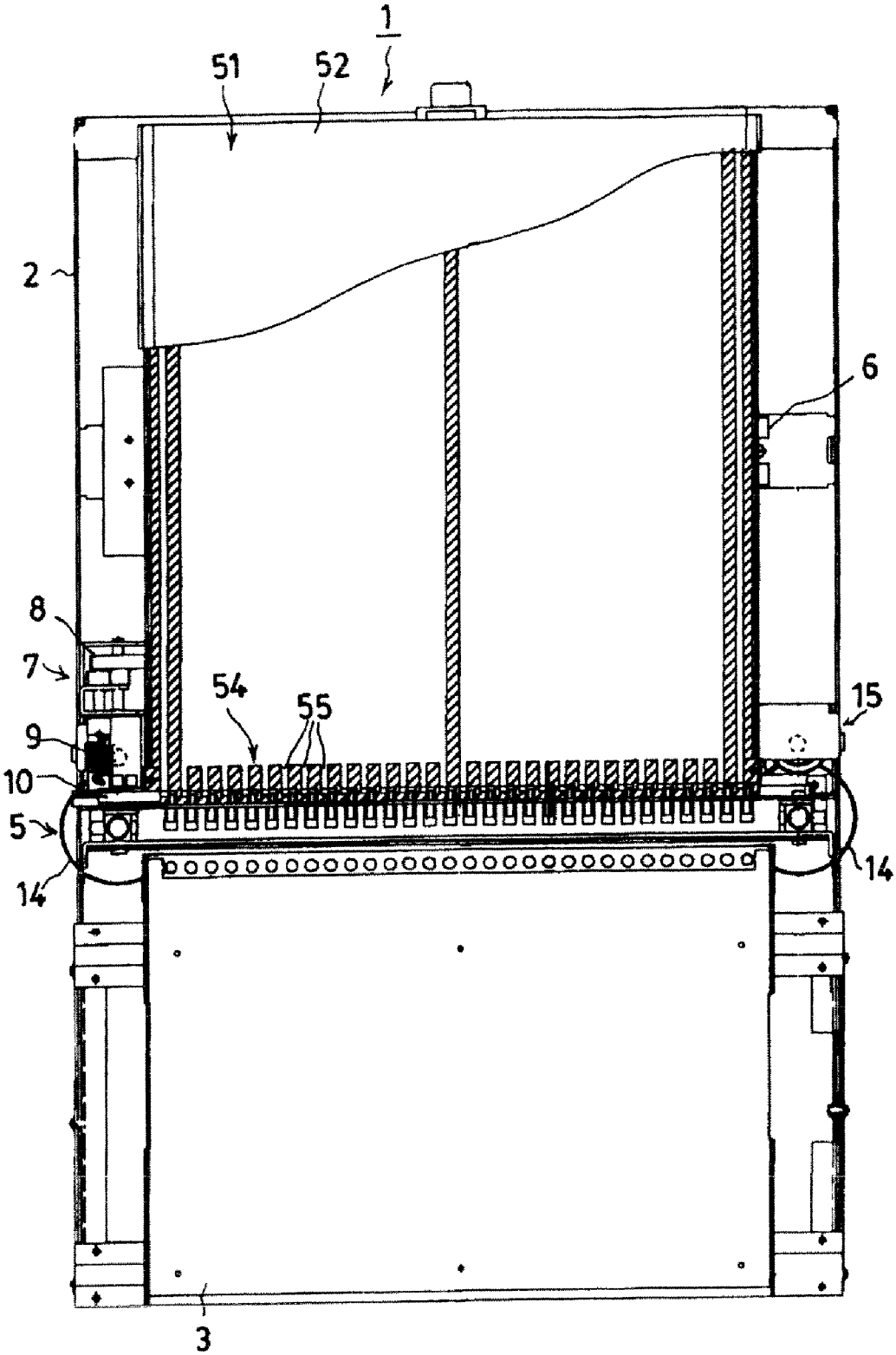
FIG. 3 is a plan view showing a bind processing device to which a binder cartridge is attached.
Figure 4:
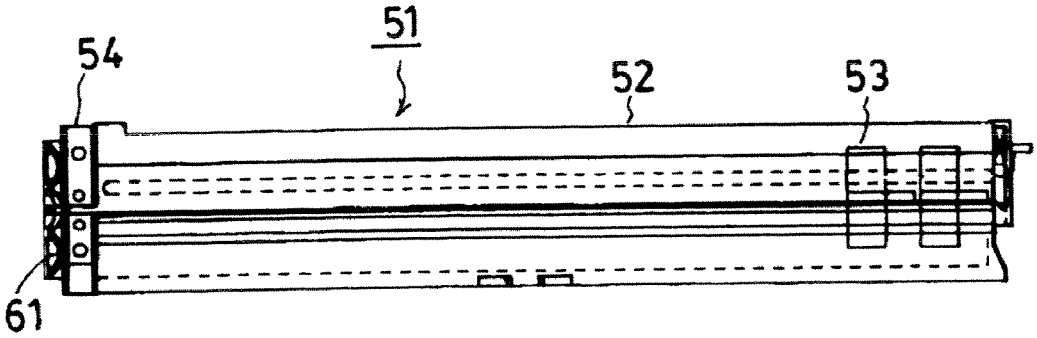
FIG. 4 is a side view showing a binder cartridge.
Figure 5:
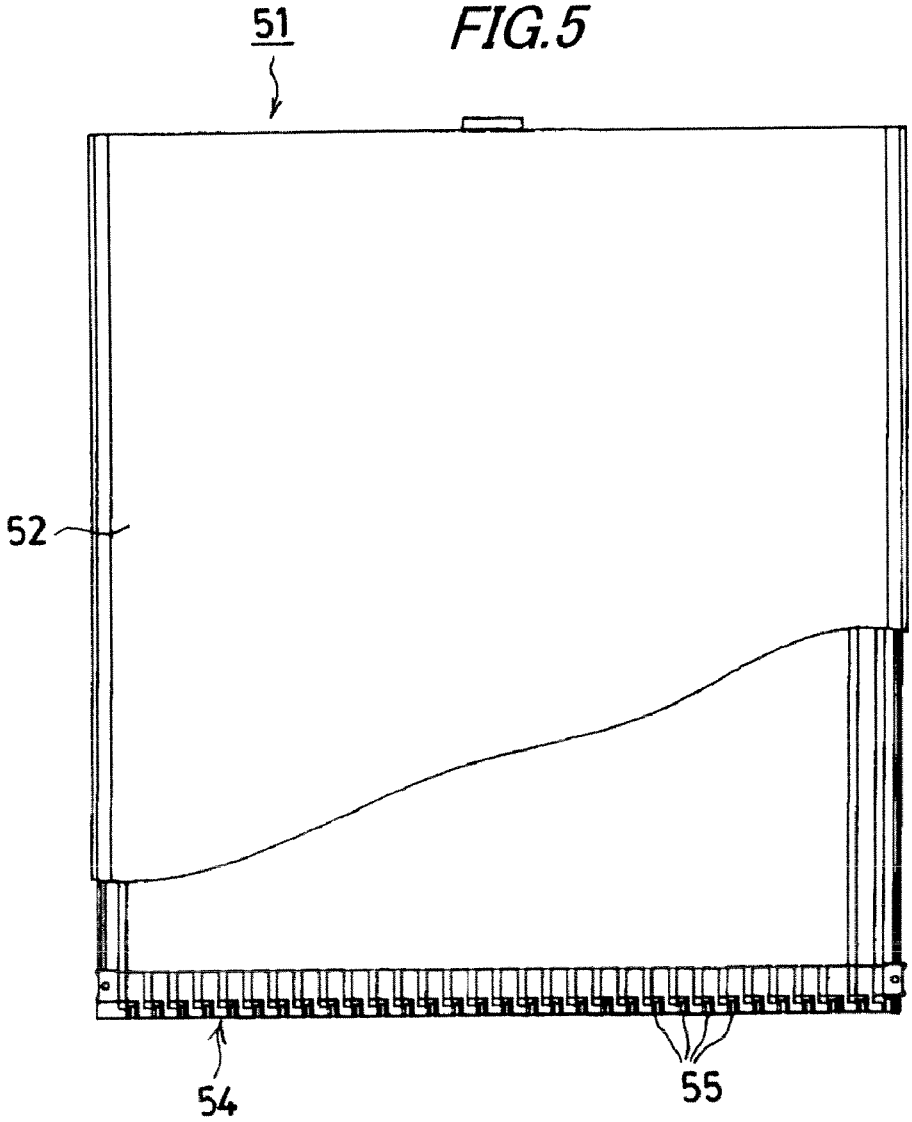
FIG. 5 is a plan view showing a binder cartridge.

FIG. 1 is a view showing a bind processing device 1 according to a first exemplary embodiment . FIGS. 2 and 3 are views showing the bind processing device 1 to which the binder cartridge 51 is attached. A sheet table 3 is arranged in the front portion (lower portion in FIG. 3) of a frame 2 of the bind processing device 1. A cartridge base 4, to which the binder cartridge 51 is attached, is provided in the rear portion (upper portion in FIG. 3) of the frame 2 of the bind processing device 1. A bind mechanism portion 5 is provided in the intermediate portion between the sheet table 3 and the cartridge base portion 4. As shown in FIGS. 4 and 5, the binder cartridge 51 is a box-shaped cartridge. After an upper lid 52 has been slid backward (to the right in FIG. 4), the binder 61 is loaded into the binder cartridge 51 from an upper portion.

Figure 6:
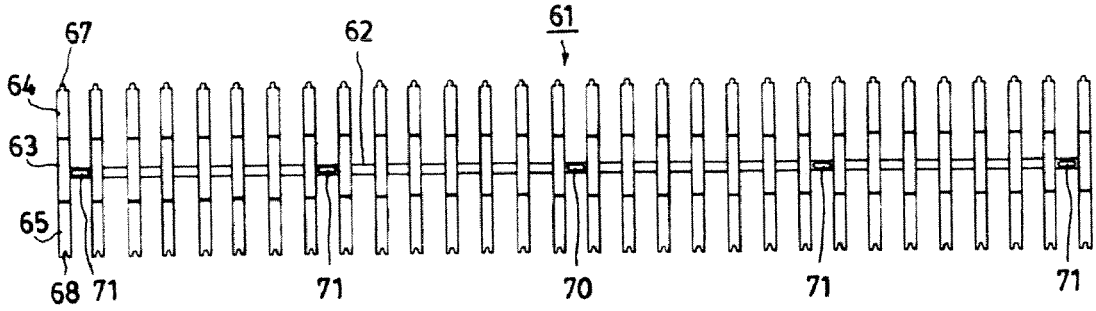
FIG. 6 is a rear view showing a binder.
Figure 7:
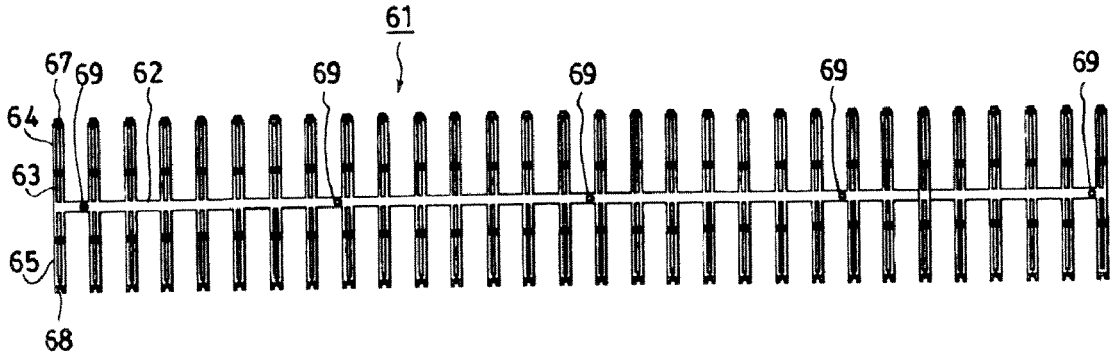
FIG. 7 is a front view showing a binder.

Next, the binder 61 will be described. FIG. 6 is a rear view of the binder 61, showing an outer circumferential face side of the binder 61. FIG. 7 is a front view of the binder 61, showing an inner circumferential face side of the binder 61. The binder 61 is made of resin and is formed by injection molding. The binder 61 has ring portions that are arranged at regular intervals along a spine portion 62. The length of the spine portion is the same as the size of a sheet of paper of regular size. As shown in FIGS. 8A, 8B, 9A and 9B, the ring portion is divided into three portions including one ⅓ central ring portion 63 and two ⅓ ring portions 64, 65, which are respectively connected to an upper portion and a lower portion of the ⅓ central ring portion 63. When the upper 64 and the lower ⅓ ring 65 are bent and the forward end portions of the two ⅓ ring portions are engaged with each other, a complete ring is formed.

Figure 8A:
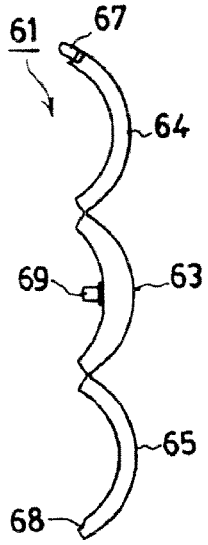
FIG. 8A is a rear view showing a binder.
Figure 8B:
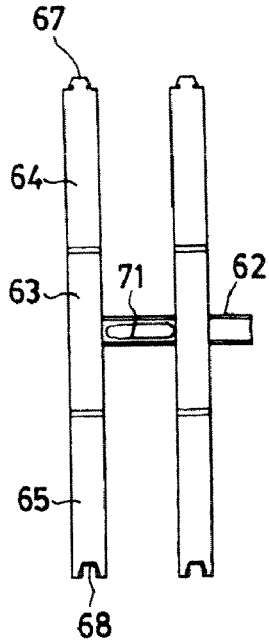
FIG. 8B is a side view showing a binder.
Figure 9A:
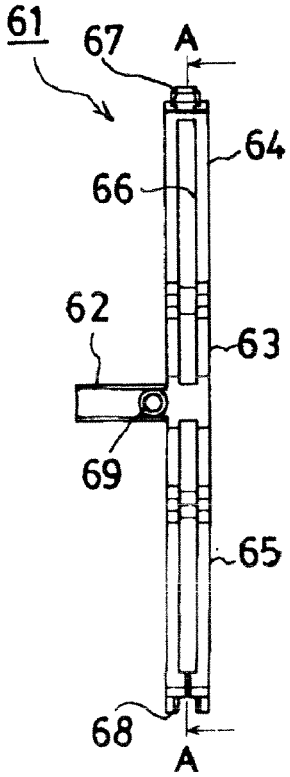
FIG. 9A is a front view showing a binder.
Figure 9B:
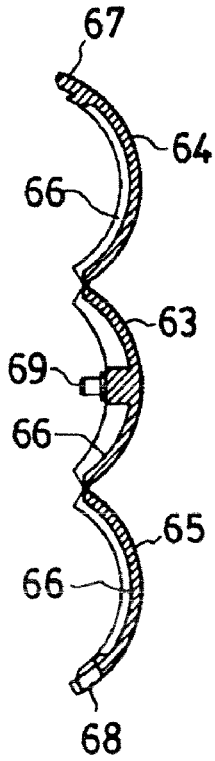
FIG. 9B is a sectional side view showing a binder.
Figure 10:
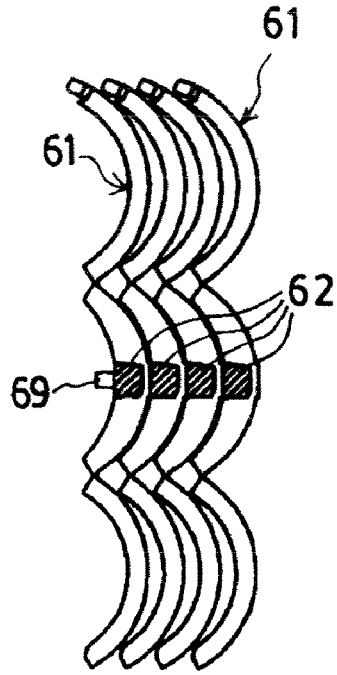
FIG. 10 is a side view showing a laminated binder.

As shown in FIG. 8A, the radius of curvature of the outer circumferential face and the radius of curvature of the inner circumferential face of the ⅓ central ring portion 63 are equal to each other. In the initial state, both end portions of each of the three ⅓ ring portions 63, 64, 65 are arranged in a substantially straight line. Therefore, as shown in FIG. 10, when a plurality of binders 61 are stacked, a front surface of one ⅓ central ring portion 63 can be provided in surface-contact with a back surface of another ⅓ central ring portion without forming any gap between the surfaces. Since the upper and lower ⅓ ring portions 64, 65 are thinner than the ⅓ central ring portion 63, gaps are seldom formed between the binders. Therefore, the binders can be effectively accommodated in the binder cartridge 51. As shown in FIGS. 9A and 9B, grooves 66 are formed on the inner circumferential faces of the three ⅓ ring portions 63, 64, 65. These grooves 66 extend in the circumferential direction. A hook portion 67 is provided at the forward end of the ⅓ upper ring portions 64. A catch portion 68, which engages with the hook portion 67, is provided at the forward end of the ⅓ lower ring portions 65.

Figure 11A:
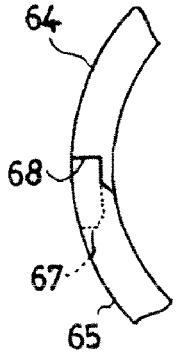
FIG. 11A is a sectional side view showing a state in which a ring of a binder is formed.
Figure 11B:
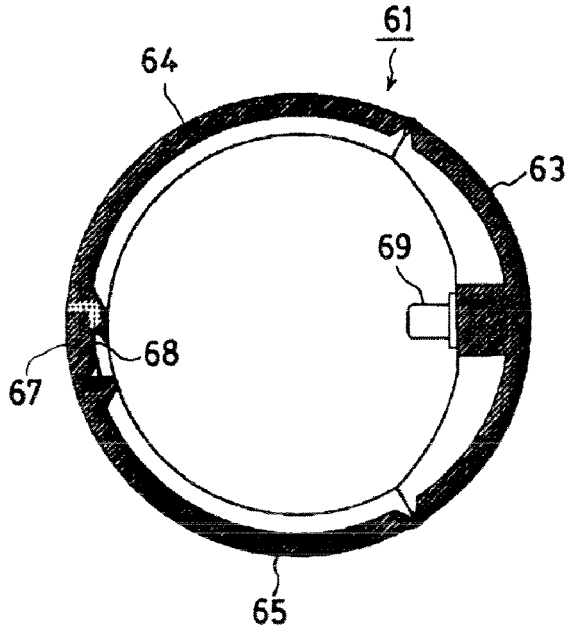
FIG. 11B is a side view showing an engaging portion of a binder.

FIGS. 11A and 11B show a state in which the hook portion 67 of the ⅓ upper ring portion 64 and the catch portion 68 of the ⅓ lower ring portion 65 are engaged with each other so that the ring can be formed. When the hook portion 67 of the ⅓ upper ring portion 64 and the catch portion 68 of the ⅓ lower ring portion 65 are engaged with each other, the ⅓ upper ring portion 64 and the ⅓ lower ring portion 65 cannot be shifted in the circumferential direction or the lateral direction. Moreover, by the joint structure composed of the forward end portion of the ⅓ upper ring portion 64 fixed to the forward end portion of the ⅓ lower ring portion 65, the ⅓ lower and ⅓ upper ring portions 64, 65 can not be shifted in the radial direction. By this connection, documents can be attached to the binder 61. In order to detach the documents from the binder 61, the ⅓ upper ring portion 64 and the ⅓ lower ring portion 65 are pulled apart from each other in the circumferential direction by an operator's hands so that the catch portion 68 is opened in the lateral direction. Therefore, the catch portion 68 and the hook portion 67 are released from each other. Of course, the thus detached binder 61 can be reused.

As shown in FIGS. 7 to 11B, pins 69 protruding to the centers of the rings are provided at regular interval on the inner face side of the spine portion 62. In this embodiment, five pins 69 are provided. As shown in FIGS. 6, 8A and 8B, grooves 70, 71, which can be engaged with the pins 69, are formed on the back side of the spine portion 62. Accordingly, when a plurality of binders 61 are stacked, as shown in FIG. 10, the pins 69 of the binder 61 in the second row are engaged with the grooves 70, 71 of the binder 61 in the front row, so that the plurality of binders 61 can be connected to each other. That is, the plurality of binders 61 cannot be separated from one another. Therefore, at the time of opening a package of the binders 61 or at the time of loading the binders 61 into a bind processing machine, the plurality of binders 61 can be easily handled.

Figure 12A:
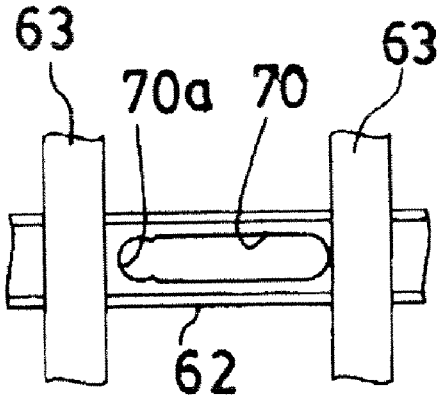
FIGS. 12A and 12B are views showing a spine portion of a binder.
Figure 12B:
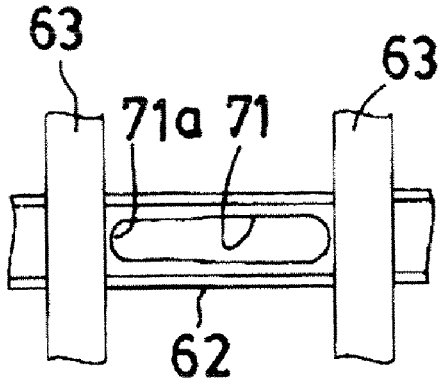

FIGS. 12A and 12B are views showing the grooves 70, 71 in detail. FIG. 12A shows a central groove 70 illustrated in FIG. 6. FIG. 12B shows a groove 71, wherein four grooves 71 except for the central groove 70 are arranged in the lateral direction in FIG. 6. On the left of the grooves 70, 71, which extend in the lateral direction, the pin engaging portions 70*a*, 71*a* are formed. The widths of the pin engaging portions 70*a*, 71*a* are equal to or smaller than the diameter of the pin 69, The widths the rest of the pin engaging portions 70*a*, 71*a* are larger than the diameter of the pin 69. Therefore, the following positional relation can be established. When a plurality of binders 61 are put on each other while both end portions of the binders 61 are aligned, the pins 69 of the binder 61 in the rear row are opposed to the left end portions of the grooves 70, 71 of the binder 61 in the front row. Accordingly, when both end portions of a plurality of binders 61 are aligned and the plurality of binders 61 are pressed to one another, the pins 69 are engaged with the pin engaging portions 70*a*, 71*a* on the left of the grooves 70, 71. In this way, a front binder 61 can be connected to a rear binder 61. However, when the front binder 61 is slid to the right in FIG. 3, the pins 69 are disengaged from the engaging portions 70*a*, 71*a* of the grooves 70, 71. Therefore, the front binder 61 can be separated from the rear binder 61.

Next, the binder cartridge 51 will be explained below. As shown in FIG. 2, the binder cartridge 51 is engaged with click pawls 6, which are arranged at the rear end and the left end of the cartridge base portion 4. Therefore, the binder cartridge is fixed to the frame 2. When the binder cartridge 51 is slid to the right or lifted upward, it can be detached from the bind processing device 1. As shown in FIG. 4, the binder cartridge 51 is provided with a spring type pusher 53. Therefore, when a plurality of binders 61, which are connected to each other, are loaded in the binder cartridge 51 and an upper lid 52 is closed, the pusher 53 comes into contact with the binder 61 in the last row and pushes the binder forward (to the left in FIG. 4). Accordingly, the binder in the front row comes into elastic contact with a gate portion 54 on the front face. A binder lamination body, that is, a plurality of binders laminated on each other in the longitudinal direction, is accommodated in the binder cartridge 51.

As shown in FIG. 5, a plurality of right angle crank-shaped guide grooves 55 are formed in the gate portion 54. These guide groove 55 are provided at positions corresponding to positions of the ring portions 63 of the binder 61. As shown in FIG. 4, a gap formed in the horizontal direction in the vertical middle portion of the binder cartridge 51 is a passage for the spine portion 62 of the binder 61. The ring portions 63, 64, 65 proceed along the crank-shaped guide groove 55.

FIGS. 13A1 to 13D2 are views showing the crank-shaped groove 55 in detail. A slider 10 of a binder lateral movement mechanism 7 will be described later. As shown in FIGS. 13A1 and 13A2, a binder 61*a*, which is the lead binder in the binder cartridge 51, enters the crank-shaped guide groove 55 from the rear portion of the gate portion 54 and comes into contact with the front wall face. Then, as shown in FIGS. 13B1, 13B2, the binder 61*a* is slid in the lateral direction (to the right when it is viewed from the front face side of FIG. 13B2) along the lateral groove portion of the crank-shaped guide groove 55 by the slider 10 of the binder lateral movement mechanism 7. Due to the foregoing, the leading binder 61*a* is separated from the binder 61*b* in the rear row.

As shown in FIG. 13C2, a wide region is formed in the front face opening of the crank-shaped guide groove 55, such that the width of the wide region is larger than the lateral widths of the ring portions 63, 64, 65. The height of the wide region is substantially the same as the diameter of the ring of an engaged binder 61. In the upper and lower portions of the front face opening of the crank-shaped guide groove 55, the right wall face is protruded to the left of the wide region, and the opening width is substantially the same as the lateral widths of the ring portions 63, 64, 65. In the center of the front end of the left wall face, a pawl-shaped stopper portion 56 is provided. The pawl-shaped stopper portion 56 protrudes to the right in FIGS. 13A1-13D2. Therefore, as shown in FIG. 13B2, the front face (i.e. the inner circumferential face) of the ⅓ center ring portion 63 of the binder 61 comes into contact with the stopper portion 56. As shown in FIGS. 13B1 and 13B2, when the leading binder 61*a* is separated from the binder 61*b* in the rear row, the right side of the leading binder 61*a* contacts the right side of the upper and lower portions of the front face opening of the crank-shaped guide groove 55. Therefore, the front face of the ⅓ center ring portion 63 comes into contact with the stopper portion 56. The stopper portion 56 prevents the ⅓ center ring portion 63 from advancing forward (i.e., down in FIG. 13B). Therefore, while the ⅓ upper and lower ring portions 64, 65 are being closed by the bind mechanism 5 described later, the binder 61*a* can not be moved forward. Therefore, the closing operation can be stably conducted.

As shown in FIGS. 13C1 and 13C2, when the ⅓ upper and lower ring portions 64, 65 are closed and the ring is formed, the ⅓ upper and lower ring portions 64, 65 move from the narrow portion of the front face opening of the crank-shaped guide groove 55 to the wide portion in the middle in the vertical direction. Due to the foregoing, the binder 61*a* can be further moved to the right. Therefore, as shown in FIGS. 13D1 and 13D2, the binder 61*a* is moved toward the right wall face side of the wide region of the front face opening of the crank-shaped guide groove 55 by the slider 10 of the binder lateral movement mechanism 7. Due to the foregoing, the ⅓ central ring portion 63 is separated from the stopper portion 56 of the crank-shaped guide groove 55. Accordingly, the closed binder 61*a* can be drawn out to the front side.

Figure 14:
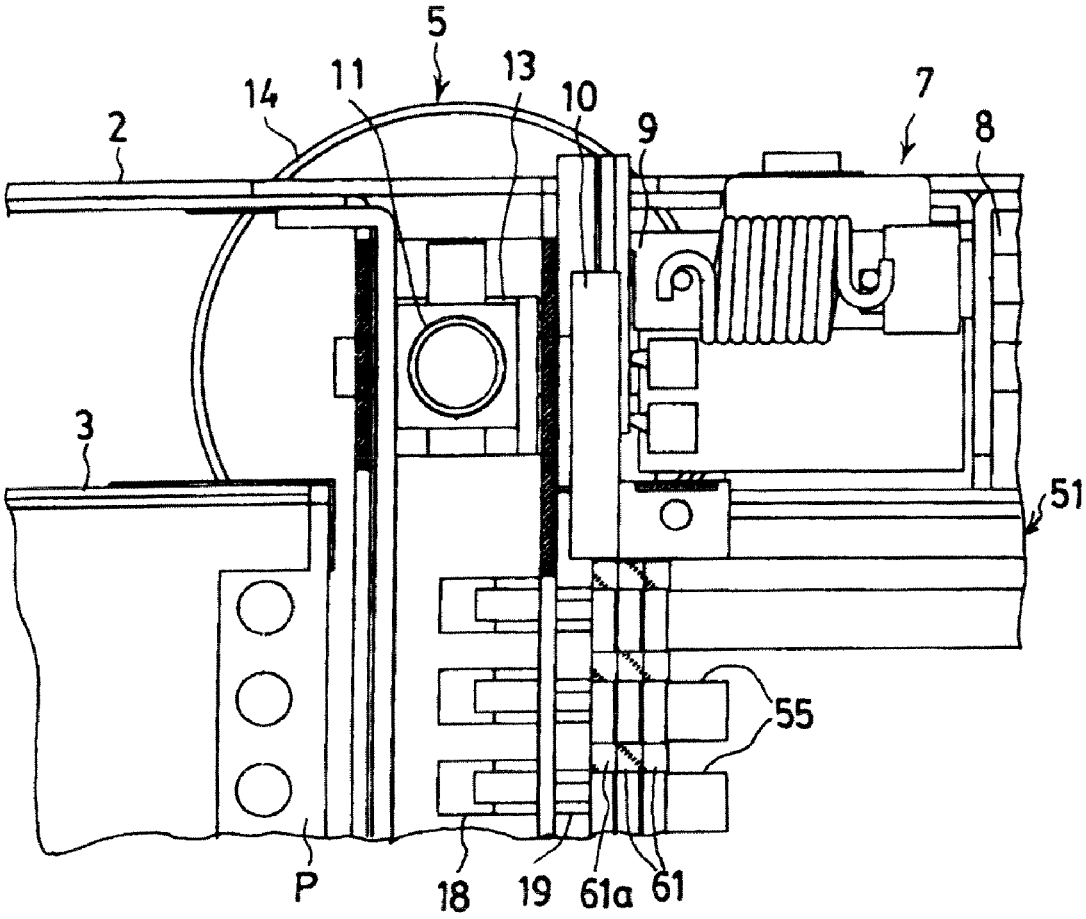
FIG. 14 is a plan view showing a binder lateral movement mechanism.
Figure 15:
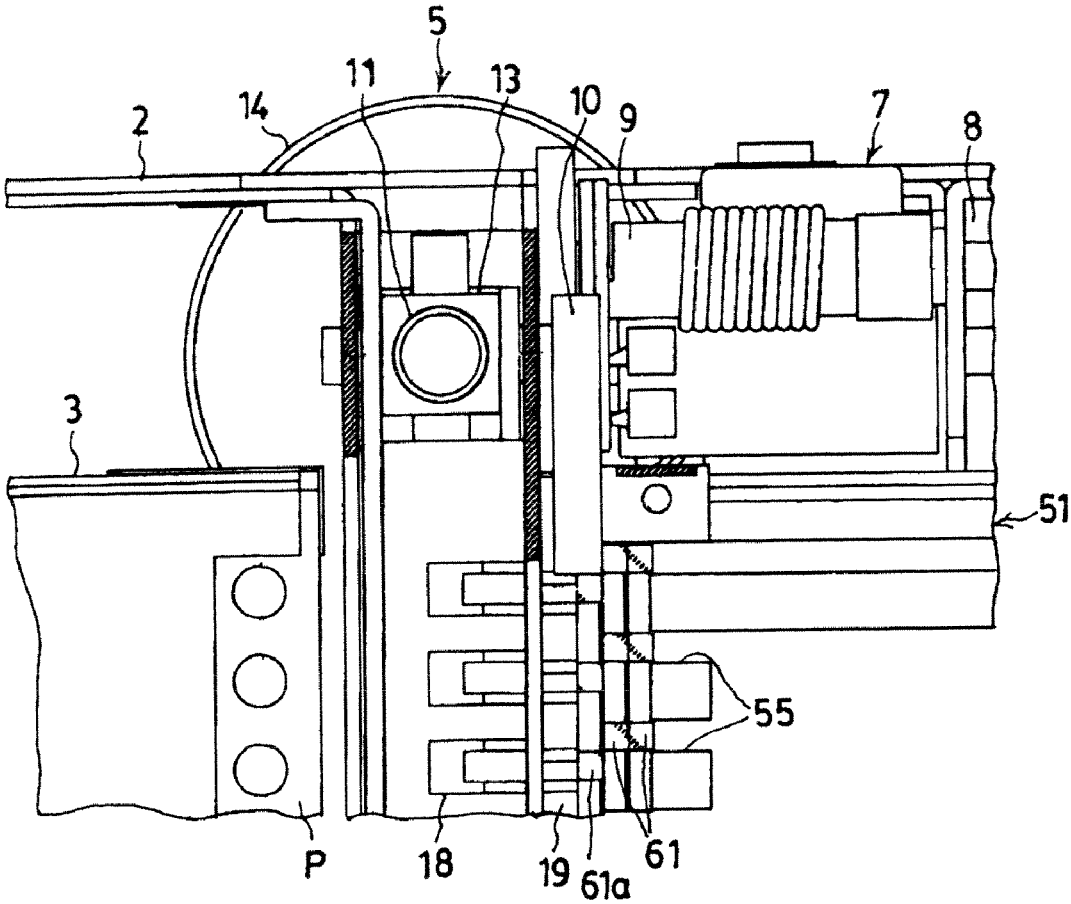
FIG. 15 is a plan view showing operation the binder lateral movement mechanism.
Figure 16:
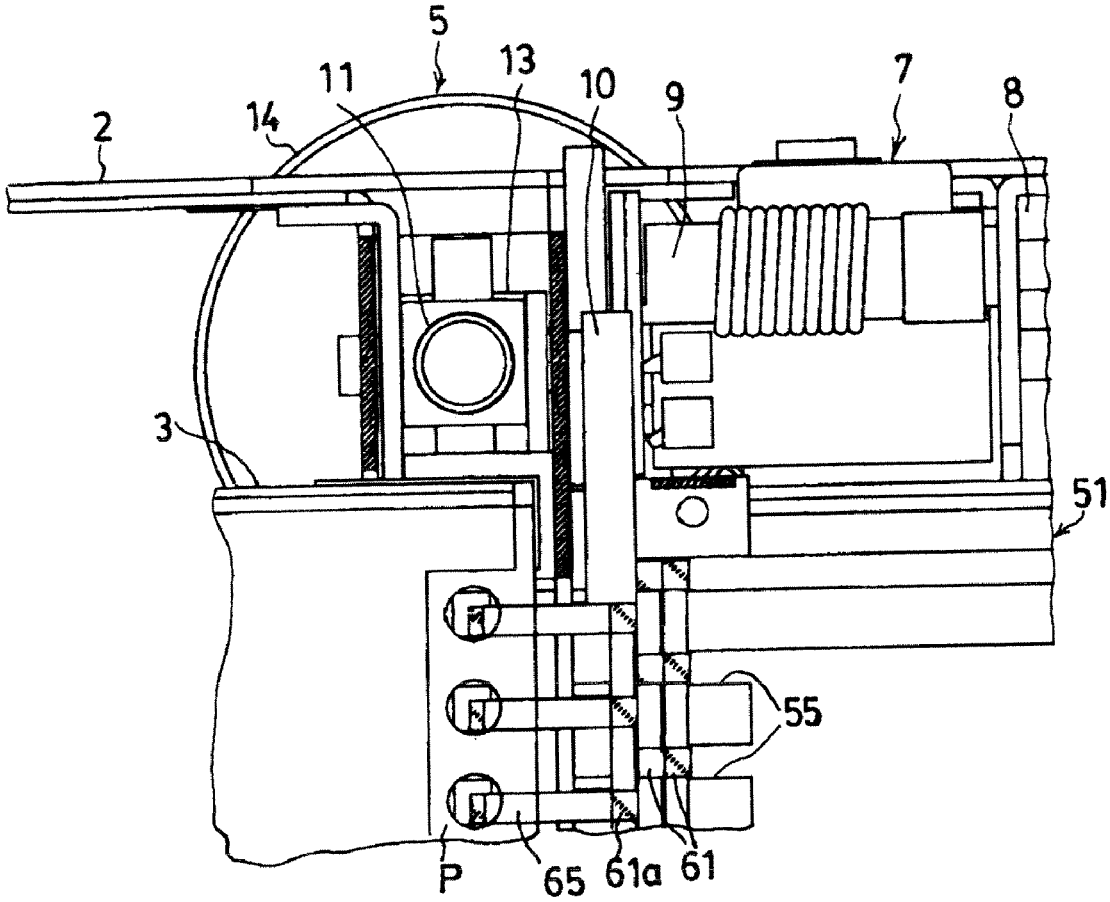
FIG. 16 is a plan view showing operation of the binder lateral movement mechanism.

As shown in FIG. 3, the binder lateral movement mechanism 7 is arranged in the left end portion of the bind mechanism portion 5. The binder lateral movement mechanism 7 reciprocates the slider 10 to the right and left by a drive motor 8 and a cam mechanism 9. FIGS. 14 to 16 are views showing operation of the binder lateral movement mechanism 7. In the initial state shown in FIG. 14, the slider 10 is located on the left of the front row binder 61*a* (i.e., at the upper portion in FIG. 14). As shown in FIG. 15, the slider 10 is driven to the right (i.e., downward in FIG. 15) via the cam mechanism 9. Therefore, the binder 61*a* in the front row is moved from the front end of the rear straight groove of the crank-shaped guide groove 55 to the rear end of the front straight groove. After that, as shown in FIG. 16, the sheet table 3, which is provided with a sheet of paper P, advances forward and the upper ⅓ ring portion 64 and ⅓ lower ring portion 65 are pinched in the vertical direction by the bind mechanism portion 5 so that the ring portion 63, 64, 65 is engaged in the punch hole of the sheet of paper P. When the sheet table 3 is retracted, the binder 61*a* is drawn out to the front side through the front straight groove of the crank-shaped guide groove 55.

If the ring portions 63, 64, 65 are engaged as described above, when the binder 61*a* in the front row is slid by the slider 10, the binder 61*a* in the front row can be separated from a plurality of rows of binders 61. However, when the binder 61*a* in the front row is fixed, and the binder cartridge 51 is slid, the binder 61*a* in the front row also can be separated from a plurality of rows of binders 61. That is, when the binder 61*a* in the front row and the binder cartridge are moved relative to each other in the lateral direction, the binder 61*a* in the front row can be separated from a plurality of rows of binders 61.

Figure 17:
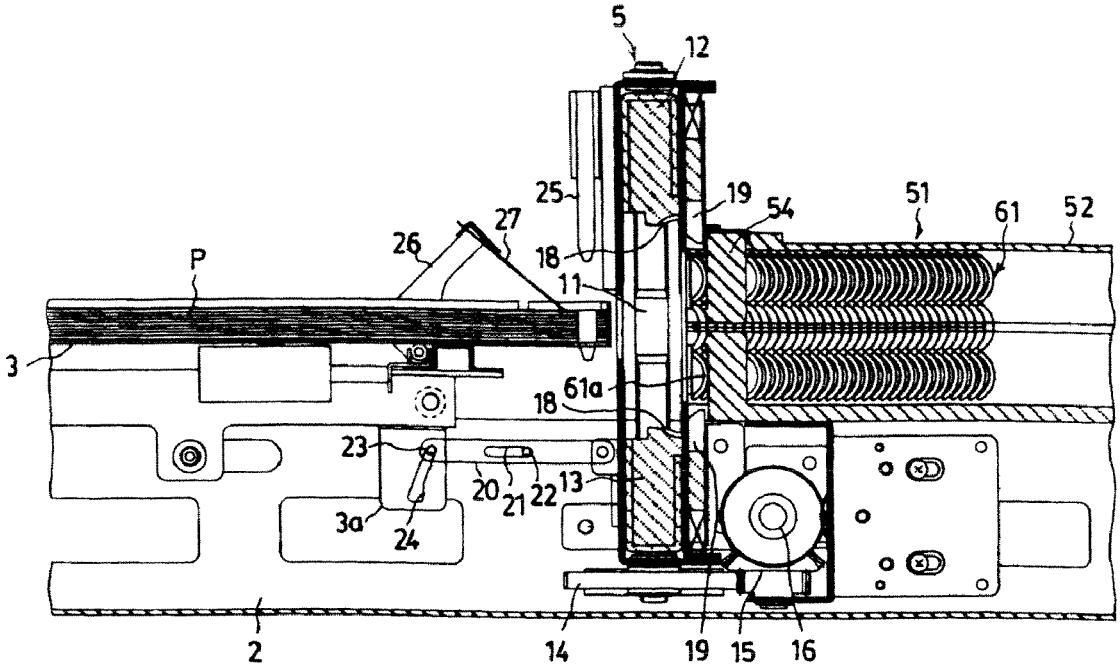
FIG. 17 is sectional side view showing a bind mechanism.

Next, the bind mechanism portion 5 of the bind processing device 1 will be explained below. As shown in FIGS. 3 and 17, the feed screw 11 is arranged in the longitudinal direction at both end portions of the bind mechanism portion 5. The feed screw 11 shown in FIG. 17 is composed of an upper half portion in which a screw is formed, and a lower half portion in which a screw inverse to the screw formed in the upper half portion is formed. The upper half portion and the lower half portion are respectively engaged with sliders 12, 13, in which a female screw is formed in the upper half portion and the lower half portion, respectively. A spur gear 14 is attached to a lower portion of the feed screw 11. This spur gear 14 is connected to a drive shaft 16 via a bevel gear reduction mechanism 15. Therefore, the feed screw mechanism is composed as follows. When the drive shaft 16 is rotated by a drive motor 17, the pair of sliders 12, 13, which are provided on the feed screw 11, can come close to or separate from each other according to the rotary direction of the drive shaft 16.

Front pushers 18 are mounted on the upper slider 12 and the lower slider 13. The front pushers 18 are thin sheets arranged in parallel to one another. The number of front pushers 18 is the same as the number of the ring of the binder 61. Rear pushers 19 are arranged on the rear face side of the front pushers 18. The number of rear pushers 19 is the same as the number of front pushers 18. The rear pushers 19 are assembled so that the rear pushers 19 can freely slide in a predetermined range in the vertical direction with respect to the front pushers 18. The rear pushers 19 are pushed by springs (not shown) in a direction so that an upper rear pusher 19 and a lower rear pusher 19 can come close to each other. In the initial state shown in FIG. 17, an interval between the rear pushers 19 is smaller than that of the front pushers 18. Faces of the upper and the lower front pushers 18, which are opposed to each other, are formed as arcuate faces corresponding to the ring shape of the binder 61. The face of the upper rear pusher 19 is the same as the face of the lower rear pusher 19, which is opposed to the upper rear pusher 19. That is, faces of the upper and the lower rear pushers 19 are formed as inclined faces corresponding to the ring shape of the binder 61.

Figure 19:
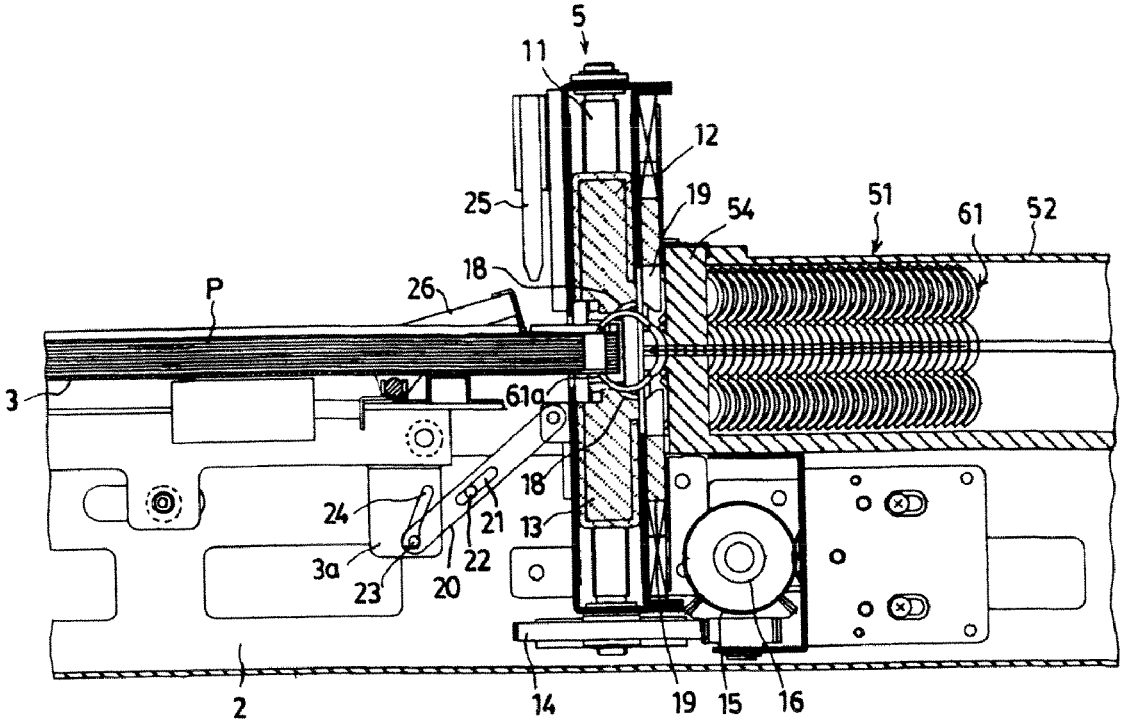
FIG. 19 is a sectional side view showing operation of the bind mechanism.

As shown in FIG. 17, the lower slider 13 of the bind mechanism portion 5 and the sheet table 3, which can be slid in the longitudinal direction with respect to the frame 2, are connected to each other via a link 20. A guide groove 21 formed in the middle portion of the link 20 is engaged with a pin 22 fixed to the frame 2. A pin 23 formed at the forward end portion of the link 20 is engaged with a guide groove 24 of a bracket 3*a* provided on the sheet table 3. Because the link is linked with the elevation of the sliders 12, 13, the link 20 is oscillated upward and downward around the fulcrum of the pin 22 of the frame 2. As shown in FIG. 19, when the lower slider 13 is raised, the sheet table 3 is pulled forward via the link 20. When the lower slider 13 is lowered and returned to the initial position, the sheet table 3 is retracted to the initial position.

Sheet arrangement pins 25, which are capable of freely elevating, are provided on the front face of the bind mechanism 5. When the sheets of paper P are put on the sheet table 3 while the punch hole side is being set at the top, the sheet arrangement pins 25 are lowered and inserted into the punch holes. In this way, the positional deviation of the punch holes of a set of sheets of paper can be corrected. The sheet arrangement pins 25 may be elevated by manual operation, however, it is preferable that the sheet arrangement pins 25 are automatically lowered and raised by a motor or an actuator at the time of setting the sheets of paper when the bind processing is automated. On the other hand, the sheet arrangement pins 25 maybe arranged below the sheets of paper P, and the positional deviation of the punch holes of the sheets of paper P may be corrected by raising the sheet arrangement pins 25 and inserting them into punch holes.

A sheet holding arm 26 is attached to the sheet table 3. A holding plate 27, which is made of sheet metal or resin, pivotally attached to a forward end portion the sheet holding arm 26. The holding plate 27 is in contact with the surface of the sheet of paper P on the sheet table 3 so that the sheet of paper P can be prevented from floating.

Next, operation of the bind processing device 1 will be explained below. FIG. 17 shows the initial state. First, the positional deviation of the punch holes of the sheets of paper P is corrected by the sheet arrangement pins 25. At the same time, the slider 10 of the binder lateral movement mechanism 7 shown in FIG. 3 slides the front row binder 61*a* in the binder cartridge 51 to the right. Therefore, the front row binder 61*a* in the binder cartridge 51 is separated from the rear row binder 61. When the leading binder is laterally moved in the lateral groove portion of the crank-shaped guide groove 55, the ⅓ upper ring portion 64 and the ⅓ lower ring portion 65 can be engaged with each other as shown in FIGS. 13B1 and 13B2.

Next, the drive motor 17 of the bind mechanism portion 5 is started. An interval formed between the upper and lower rear pushers 19 is reduced, and an interval formed between the front pushers 18 is also reduced. In accordance with the rising motion of the lower slider 13, the sheets of paper P proceed toward the bind processing position together with the sheet table 3.

Figure 18:
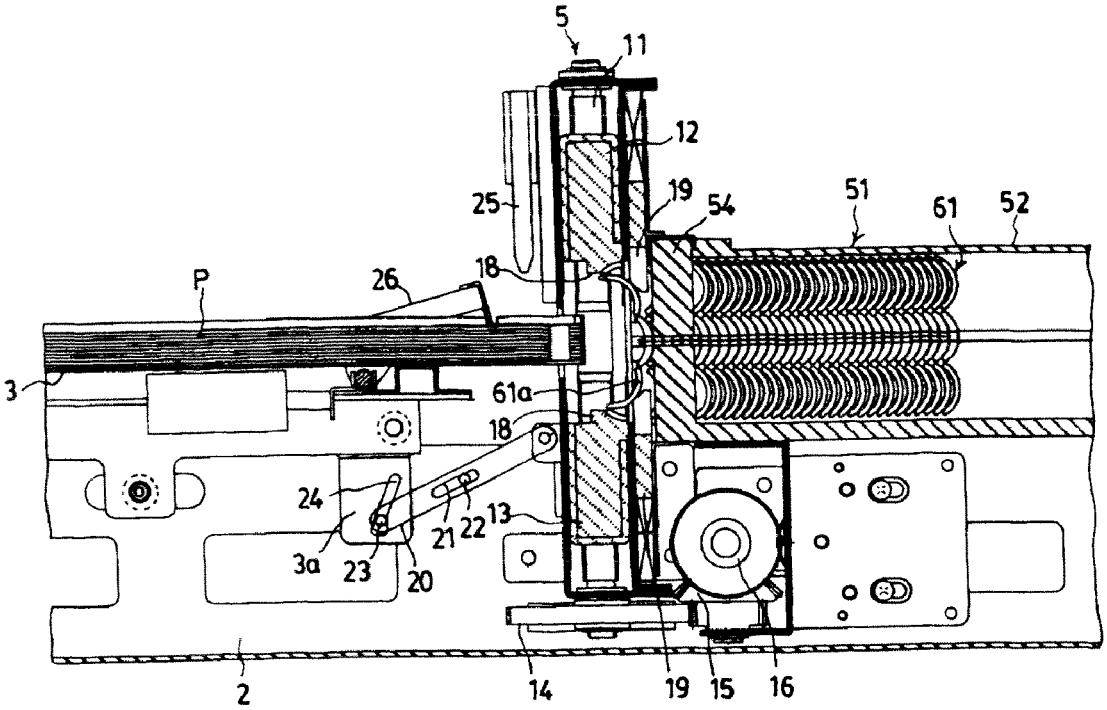
FIG. 18 is a sectional side view showing operation of a bind mechanism.
Figure 20:
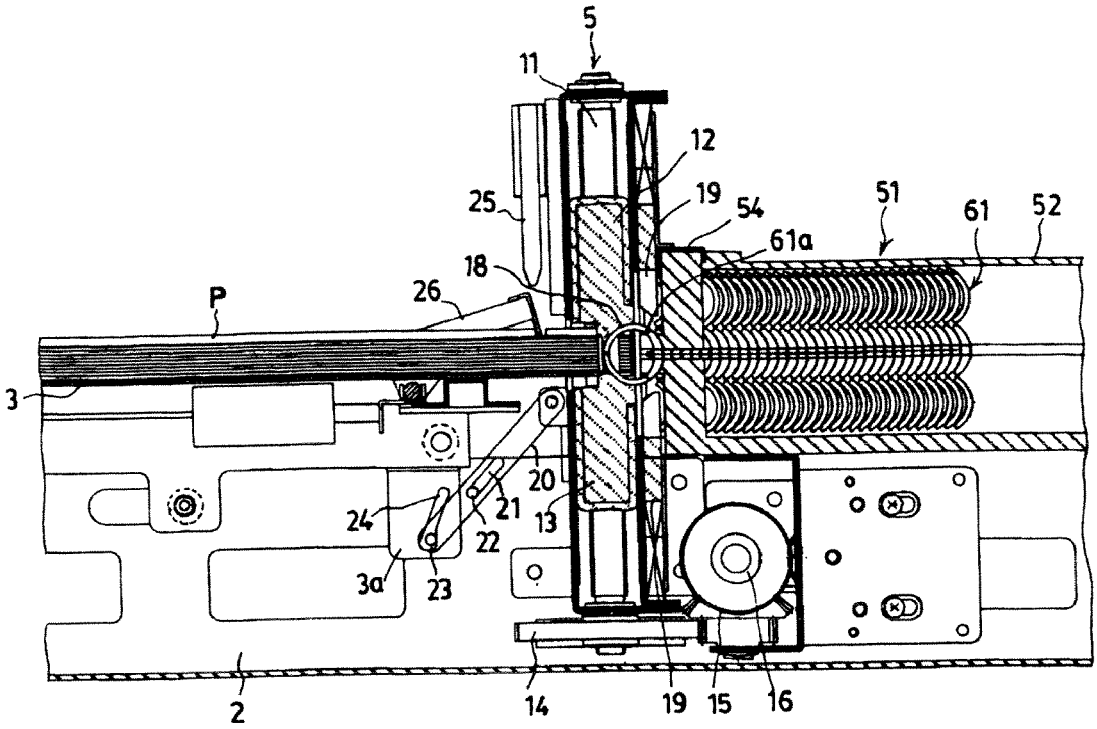
FIG. 20 is a sectional side view showing operation of the bind mechanism.

As shown in FIG. 18, first, the upper and lower rear pushers 19 come into contact with the back faces of the ⅓ upper ring portion 64 and the ⅓ lower ring portion 65 of the binder 61. Therefore, the ⅓ upper ring portion 64 and the ⅓ lower ring portion 65 are bent forward. Due to the foregoing, the forward end portions of the ⅓ upper ring portion 64 and the ⅓ lower ring portion 65 enter between the upper and lower front pushers 18. As shown in FIG. 19, the upper and lower rear pushers 19 stop when they reach a position at which the upper and lower rear pushers 19 are closest to each other in the movable range. However, the interval between the upper and lower front pushers 18 is further reduced. Therefore, the upper and lower front pushers 18 pinch the ⅓ upper ring portion 64 and the ⅓ lower ring portion 65. Accordingly, the ⅓ upper ring portion 64 and the ⅓ lower ring portion 65 are engaged with each other as shown in FIG. 20. The sheet table 3 advances forward very slowly until the forward end portions of the ⅓ upper ring portion 64 and the ⅓ lower ring portion 65, respectively, enter the punch holes and engage with each other. Therefore, as the ⅓ upper ring portion 64 and the ⅓ lower ring portion 65 proceed into the columnar, cavity-shaped punch holes, the ⅓ upper ring portion 64 and the ⅓ lower ring portion 65 do not catch the edges of the inner surfaces of the punch holes. Therefore, the ⅓ upper ring portion 64 and the ⅓ lower ring portion 65 can be smoothly engaged with each other.

Figure 21:
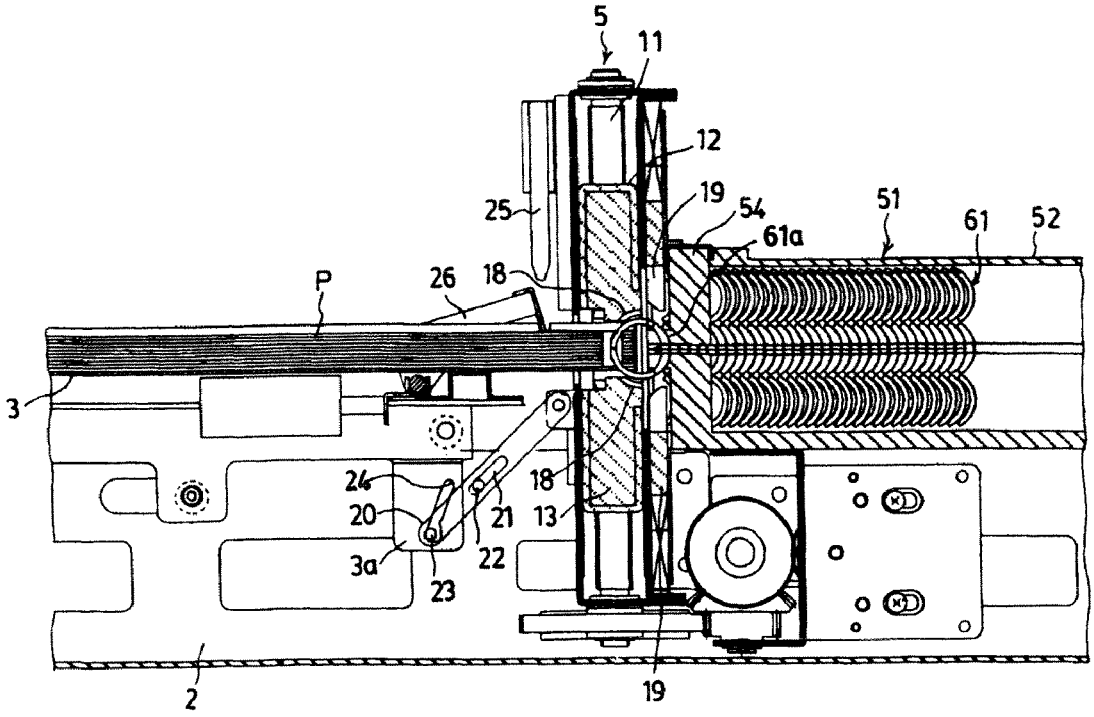
FIG. 21 is a sectional side view showing operation of the bind mechanism.

After the completion of binding operation, the binder is further moved to the right by the slider 10 of the binder lateral movement mechanism 7 (shown in FIGS. 13D1 and 13D2) so that the binder can be taken out to the front side. At the same time, the drive motor 17 is reversed. Therefore, as shown in FIG. 21, the upper and lower front pushers 18, the rear pushers 19, and the sheet table 3 are moved to the initial positions. Therefore, the leading binder 61 connected to the sheets of paper P is drawn out to the front from the crank-shaped guide groove 55 of the binder cartridge 51.

Second Embodiment

Figure 22A:
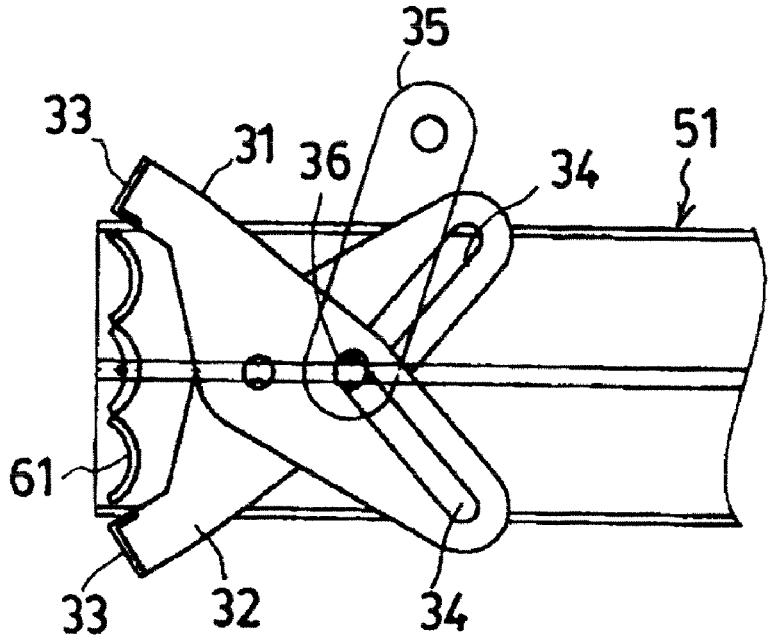
FIGS. 22A and 22B are side views showing a bind mechanism relating to a second embodiment.
Figure 22B:
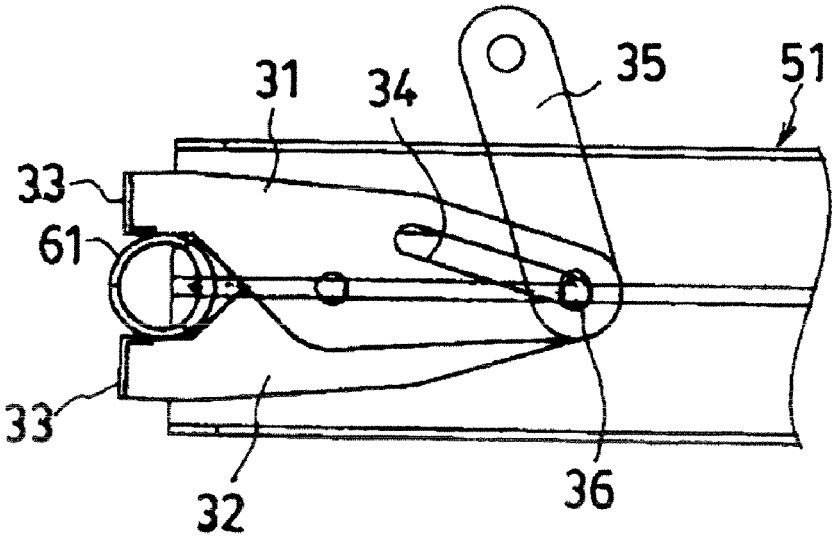

FIGS. 22A and 22B are views showing another embodiment of the bind mechanism portion. Two levers 31, 32, which are connected to each other with a pin like scissors are arranged at both end portions of the frame. Comb-shaped pusher plates 33 are attached at the respective forward end portions of the two levers 31, 32. Guide grooves 34 are formed at the rear end portions of the two levers 31, 32. A pin 36 of a drive lever 35 is engaged with each guide groove 34. As shown in FIG. 22B, when a forward end portion of the drive lever 35 is rotated backward, the forward end portions of the two levers 31, 32 are closed and pinch the binder 61, which is located between the forward end portions, from both sides, so that the ⅓ upper ring portion 64 and the ⅓ lower ring portion 65 are engaged with each other. Although not shown in the drawing, it is preferable that the pin 36 and the link 20 shown in FIG. 17 are linked with each other and the sheet table is moved according to the movements of the levers 31, 32.

The bind processing method, the bind processing device and the binder cartridge described in the above embodiments can be built in a finisher device provided in a copier or a printer. In this case, the finisher device is defined as a device for processing a bundle of sheets of paper after the completion of copying or printing. In the case where this finisher device has a punch processing device and a bind processing device described in each embodiment, a bundle of sheets of paper, on which copying or printing has already been conducted, are subjected to punching and then binding. Due to the foregoing, the sheets of paper, which have already been copied or printed, can be bound. In the case where loose leaf sheets of paper, on which punch holes have been formed at the beginning, are copied or printed out, a bundle of sheets of paper, which have already been copied or printed out, can be subjected to bind processing. In this case, the finisher device may not be provided with a punch processing device. Even when the finisher device is provided with a punch processing device, punching may not be conduced by the device.

Further, the bind processing method, the bind processing device and the binder cartridge described in the above embodiments can be built in a binding device. For example, the binding device can be provided with a copier or a printer. In the case of a copier, when documents are set in the copier, or in the case of a printer, when document data is inputted into the printer, and an object to be bound is copied or printed out, a bundle of sheets of paper, which have already been copied or printed out, can be bound. In the case where this finisher device is provided with a punching device and a bind processing device described in the embodiment, a bundle of sheets of paper, which have already been copied or printed out, are punched and then bound. In this way, the sheets of paper, which have been copied or printed out, can be bound. In the case where loose leaf sheets of paper, on which punch holes have already been formed, are copied or printed out, a bundle of sheets of paper, which have already been copied or printed out, can be subjected to bind processing. In this case, the finisher device may not be provided with a punching device. Even when the finisher device is provided with a punching device, punching need not be conducted.

In this connection, it should be noted that the present invention is not limited to the above specific embodiments. Variations may be made by those skilled in the art without departing from the scope and sprit of the present invention. Of course, the present invention includes those variations.

According to the bind processing method and the bind processing device of the present invention, the forward end portions of the division rings are mechanically engaged with each other. Therefore, the conventional problem, which is caused when the binder attaching processing is conducted by a hand work, can be solved and the processing efficiency can be remarkably enhanced. Since a pair of pushers are symmetrically opened and closed by the feed screw or the lever, the division rings can be stably engaged with each other. Accordingly, a failure of engagement is seldom caused. When the binder lateral movement mechanism for separating the leading binder from the other binders, which are connected in parallel to each other, is provided, it is possible to charge a large number of binders into the cartridge and continuously process them. Therefore, it is possible to realize a compound processing device in which the bind processing device of the invention is combined with a copier.

The invention claimed is:

1. A bind processing device for use with a binder comprising a continuous rectangular bar-like spine portion and ring portions arranged at regular intervals along both sides of the spine portion, each of the ring portions comprising a central ⅓ ring connected to the spine portion, a first ⅓ ring connected to the central ⅓ ring by a hinge and a second ⅓ ring connected to the central ⅓ ring by a hinge, the binding processing device comprising:

a first pusher and a second pusher;

a drive mechanism that symmetrically drives the first and second pushers; and a drive motor that drives the drive mechanism, wherein the first pusher and the second pusher are configured to be driven in a closing direction so as to close the ring portions of the binder so that respective pairs of forward end portions of the first ⅓ rings and the second ⅓ rings are engaged with each other within punch holes on the sheets of loose leaf paper;

the drive mechanism comprising:

a pair of levers connected with each other by a pin; and a lever opening and closing drive mechanism.

2. The bind processing device according to claim 1, wherein the first and second pushers comprise:

primary first pushers and primary second pushers, which are arranged in a longitudinal direction, and secondary first pushers and secondary second pushers, the primary first pushers and the primary second pushers pinch back face sides of the first ⅓ rings and the second ⅓ rings and rotate the first ⅓ rings and the second ⅓ rings, and the secondary first pusher and the secondary second pusher pinch forward end portions of the first ⅓ rings and the second ⅓ rings so that the forward end portions of the opposing first ⅓ rings and the second ⅓ rings engage each other.

3. The bind processing device according to claim 1, further comprising:

a sheet table for supporting sheets of paper to be bound; and a table moving mechanism for advancing and retreating the sheet table to the binder, wherein when binding is conducted by the first and second pushers, the sheet table is advanced toward the binder so as to suppress occurrence of abrasion caused between the division ring portions and the inner wall faces of the punch holes when the ring portions of the binder proceed into the punch holes.

4. The bind processing device according to claim 3, further comprising:

a pin provided on an upper side of the sheet table, wherein the pin is inserted into one of the punch holes of each of the sheets of paper on the sheet table so as to correct a positional deviation of the punch hole of each of the sheets of paper.

5. The bind processing device according to claim 1, further comprising:

a mechanism configured to separate one binder from a stack of a plurality binders, wherein the one binder which is separated is used as said binder for binding the sheets of papers.

6. A bind processing device for use with a binder comprising a continuous rectangular bar-like spine portion and ring portions arranged at regular intervals along both sides of the spine portion, each of the ring portions comprising a central ⅓ ring connected to the spine portion, a first ⅓ ring connected to the central ⅓ ring by a hinge and a second ⅓ ring connected to the central ⅓ ring by a hinge, the binding processing device comprising:

a first pusher and a second pusher;

a drive mechanism that symmetrically drives the first and second pushers; and a drive motor that drives the drive mechanism, wherein the first pusher and the second pusher are configured to be driven in a closing direction so as to close the ring portions of the binder so that respective pairs of forward end portions of the first ⅓ rings and the second ⅓ rings are engaged with each other within punch holes on the sheets of loose leaf paper;

the drive mechanism comprising:

a feed screw arranged in the longitudinal direction having a first half portion in which a screw is formed and a second half portion in which a screw inverse to the screw of the first half portion is formed; and a first slider and a second slider, the first slider comprising a female screw and second slider comprising a female screw, the female screws of the first slider and the second slider can be engaged with the first half portion and the second half portion of the feed screw.

7. A finisher device for using a binder, the binder comprising a continuous rectangular bar-like spine portion and ring portions arranged at regular intervals along both long sides of the spine portion, each of the ring portions comprising a center ⅓ ring connected to the spine portion, a first ⅓ ring connected to the central ⅓ ring by a hinge and a second ⅓ ring connected to the central ⅓ ring by a hinge, the finisher device comprising:

a first pusher and a second pusher;

a drive mechanism for symmetrically driving the first and second pushers; and a drive motor that drives the drive mechanism, wherein the first and second pushers are driven in the closing direction so as to close the ring portions of the binder, and respective pairs of forward end portions of the first ⅓ rings and the second ⅓ rings are engaged with each other within punch holes on the sheets of loose leaf paper, the drive mechanism comprising:

a pair of levers connected with each other by a pin; and a lever opening and closing drive mechanism.

8. The finisher device according to claim 7, further comprising:

a mechanism configured to separate one binder from a stack of a plurality binders, wherein, the one binder which is separated is used as said binder for binding the sheets of papers.

9. A bookbinding device for using a binder, the binder comprising a continuous rectangular bar-like spine portion and ring portions arranged at regular intervals along both long sides of the spine portion, each of the ring portions comprising a central ⅓ ring connected to the spine portion, a first ⅓ ring connected to the central 1/36 ring by a hinge and a second ⅓ ring connected to the central ⅓ ring by a hinge, the bookbinding device comprising:

a first pusher and a second pusher;

a drive mechanism for symmetrically driving the first pusher and the second pusher; and a drive motor that drives the drive mechanism, wherein the first and second pushers are driven in the closing direction so as to close the ring portions of the binder, and respective pairs of forward end portions of the first ⅓ rings and the second ⅓ rings are engaged with each other within punch holes on the sheets of loose leaf paper, the drive mechanism comprising:

a pair of levers connected with each other by a pin; and a lever opening and closing drive mechanism.

10. The bookbinding device according to claim 9, further comprising:

a mechanism configured to separate one binder from a stack of a plurality binders, wherein the one binder which is separated is used as said binder for binding the sheets of papers.

* * * * *

UNITED STATES PATENT AND TRADEMARK OFFICE

CERTIFICATE OF CORRECTION

PATENT NO. : 7,901,172 B2
APPLICATION NO. : 12/713854
DATED : March 8, 2011
INVENTOR(S) : Toru Yoshie It is certified that error appears in the above-identified patent and that said Letters Patent is hereby corrected as shown below:

Title Page

Item (30), Foreign Application Priority Data, should read:

--Aug. 12, 2003 (JP) ..... 2003-292510

Aug. 11, 2004 (JP) ..... PCT/2004/011797--

Signed and Sealed this
Third Day of July, 2012

David J. Kappos

David J. Kappos
*Director of the United States Patent and Trademark Office*